United States Patent [19]

Quarve

[11] 4,383,475

[45] May 17, 1983

[54] HYDRAULIC CYLINDER AND PISTON WITH AUTOMATIC RECIPROCATION VALVE

[75] Inventor: Vernon K. Quarve, Minneapolis, Minn.

[73] Assignee: Graco Inc., Minneapolis, Minn.

[21] Appl. No.: 241,668

[22] Filed: Mar. 9, 1981

[51] Int. Cl.[3] ..... F01B 7/18; F01L 23/00

[52] U.S. Cl. ..... 91/337; 91/321; 91/342

[58] Field of Search ..... 91/342, 337, 323, 276, 91/341 R, 321; 92/108

[56] References Cited

U.S. PATENT DOCUMENTS

| | | | |
|---|---|---|---|
| 1,405,773 | 2/1922 | Folberth | 91/342 |
| 2,556,680 | 6/1951 | Davis | 91/342 |
| 3,561,325 | 2/1971 | Lamb et al. | 91/341 R |
| 4,079,660 | 3/1978 | Ives | 91/342 |

FOREIGN PATENT DOCUMENTS 63691 9/1927 Sweden .

*Primary Examiner*—Paul E. Maslousky
*Attorney, Agent, or Firm*—Paul L. Sjoquist

[57] ABSTRACT

A reciprocation valve for a hydraulically actuated reciprocation motor, wherein the motor has hydraulic inlet and outlet passages into a cylinder through a porting block, and a slidable collar is fitted over the porting block for selectively opening and closing the passages, and a lightweight carriage assembly is attached to the collar and is actuated by a trip rod coupled to a piston within the cylinder.

18 Claims, 5 Drawing Figures

Fig. 1
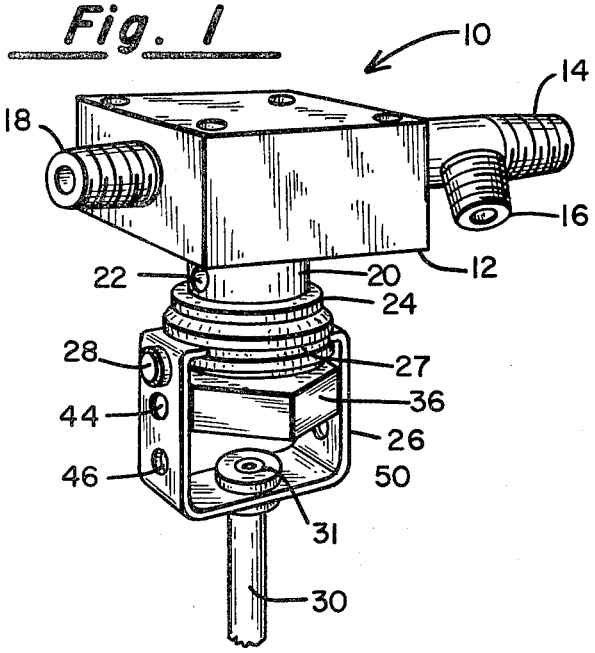
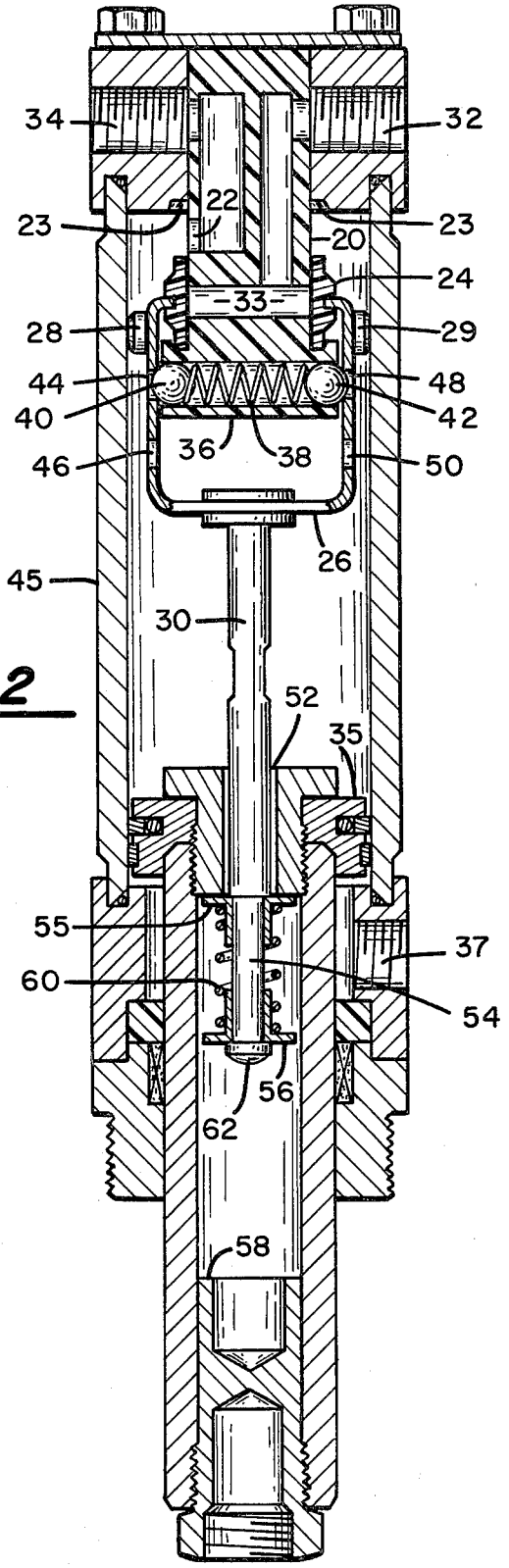
Fig. 2
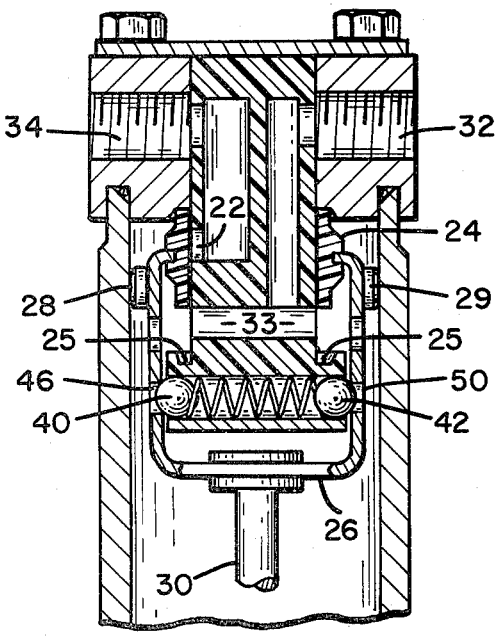
Fig. 3

HYDRAULIC CYLINDER AND PISTON WITH AUTOMATIC RECIPROCATION VALVE

BACKGROUND OF THE INVENTION

This invention relates to linear reciprocating motors, and preferably to motors of this type wherein a piston reciprocates within a cylinder under the control of pressurized hydraulic oil. More particularly, the invention relates to an improved reciprocating valve for controlling the motion of such a piston.

The construction and operation of reciprocating motors has long been known in the prior art, such motors being designed to permit pressurized hydraulic oil first into one end of a cylinder to force a piston to linearly move within the cylinder, and then into the other end of the cylinder to cause the piston to reciprocate in the other direction. The control of oil flow into such a motor is accomplished by a reciprocation valve and a trip rod or lever connected between the valve and the piston. The trip rod is designed so as to be contacted by the piston at both extremes of piston reciprocation, and to cause movement thereby to toggle the reciprocation valve into one of two valving positions. The selective toggling of the reciprocation valve causes a change in oil flow into the cylinder and redirects the oil pressure forces to reverse the axial piston motion within the cylinder.

A principal problem in the design of such reciprocating motors has been the reciprocation valve. The valve must distinctly occupy one of two valve porting positions, and must move to each of the two positions immediately upon actuation of the toggling member. Care must be used in examining worst case operating conditions to ensure that no valve "dead spot" occurs which would otherwise permit the valve to position itself intermediate the two operational positions. Various detent mechanisms have been used to provide positive valve positioning, and positive valve stops have been incorporated into the design to prevent the valve from moving beyond its designed stop positions. Since the valve controls the flow of pressurized hydraulic oil a good seal must be provided within the valve to prevent oil leakage, even after millions of cycles of usage.

To accomplish the design requirements of such a reciprocation valve the prior art has utilized a spool valve construction, usually in combination with a spring-loaded detent mechanism for positively stopping spool valve movement in either of two positions. For example, Swedish Pat. No. 63691, issued on Sept. 13, 1927, shows the typical spool valve construction commonly found in reciprocating motors of this type. U.S. Pat. No. 4,079,660, issued Mar. 21, 1978, shows a variation of spool valve construction. In such prior art designs a generally cylindrically shaped spool is slidable within a cylinder into flow communication with various ports. The spool itself is ported to provide an oil flow communication path, and the spool is typically actuated by a rod which comes into contact with the piston at or near the extreme piston travel positions. Positive valve stops are usually provided to ensure that the spool valve does not travel beyond either of its stop positions. In such valves the spool is constructed of a relatively high mass material, sufficient to withstand the porting of pressurized oil and the repetitive mechanical contact with stops. This contact produces an audible noise each time the valve reciprocates, and adds to the overall noise level of operation of such motors. Because of the relatively high mass of the spool valve the toggling mechanism must also be of sturdy construction, all of which adds to the cost of design and manufacture of such valves.

SUMMARY OF THE INVENTION

The present invention provides an improvement in the design of reciprocation valves, by providing a valve having low mass and positive displacement between two valve positions, and significant reduction in audible noise upon actuation of the valve. The valve utilizes a fixed porting block which has valve porting passages therein, and a slidable collar fitted over the porting block for selectively opening and closing the passages. The collar is connected to a lightweight carriage assembly for sliding actuation, and the carriage assembly is connected to a trip rod which is actuable by the reciprocating piston. A small, spring-loaded detent mechanism is utilized to positively position the carriage assembly in either of two positions.

It is therefore a principal object of the invention to provide a low mass reciprocation valve having improved positioning and noise generation qualitites.

It is another object of the present invention to provide an improved reciprocation valve which can be manufactured at low cost without sacrifice of reliability.

It is a further object of the present invention to provide a reciprocation valve having cushioned valve stop assemblies to reduce mechanical shock and noise problems.

BRIEF DESCRIPTION OF THE DRAWINGS

An understanding of the construction and operation of the invention will become known from the following description of the preferred embodiment, and with reference to the appended drawings, in which:

FIG. 1 is a perspective view of the invention; and

FIG. 2 is an elevation view and cross section of the invention mounted in a cylinder;

FIG. 3 is a partial cross-sectional view of the invention in a second actuating position;

DESCRIPTION OF THE PREFERRED EMBODIMENT

Figure 4:
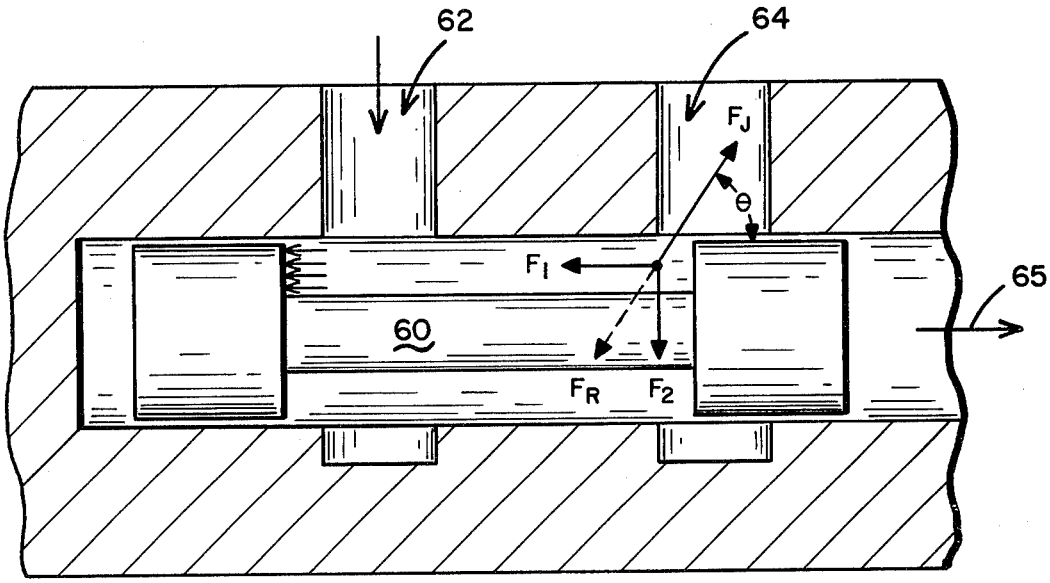
PRIOR ART Fig. 4
FIG. 4 is a simplified diagram of a prior art device.

Referring first to FIG. 1, reciprocation valve assembly 10 is shown in perspective view. A porting block 12 has passages therein, and an inlet coupling 14 is threadably attached thereto. An outlet coupling 18 is also threadably attached to porting block 12. A source of pressurized hydraulic oil is coupled to inlet coupling 14, and a return coupling is attached to outlet coupling 18 to return oil back to the source. Porting block 12 has a cylindrical neck 20 which also has passages therein, one of which is passage 22 which opens through the side of neck 20, and is in flow communication with coupling 18. Passage 33 also opens through the side of neck 20, and is in flow communication with inlet 32 (FIG. 2). Coupling 16 is connected to inlet 37 through an external tube or hose (not shown).

A slidable collar 24 is fitted over neck 20 in slidable but fluid sealing relationship. Collar 24 has an annular groove 27 into which is fitted the respective ends of a C-shaped carriage 26. A trip rod 30 is fixedly attached to carriage 26 by fastener 31. Neck 20 has an enlarged shoulder 36 at its lower end. Shoulder 36 has a hole cross-drilled therethrough, and a spring-biased detent assembly is mounted in this hole.

FIG. 2 illustrates the detent assembly in cross-sectional view, wherein a coil spring 38 is compressed between two balls 40 and 42. Balls 40 and 42 press outwardly against carriage 26, and become partially seated in holes in carriage 26 which are smaller than the respective ball diameters. For example, holes 44 and 46 are sized to partially seat bakll 40, and to thereby form a detent mechanism. Similarly, holes 48 and 50 are sized to partially seat ball 42 and to thereby form a detent mechanism.

Trip rod 30 extends downwardly through an opening 52 in piston 35. The lower end of rod 30 is of reduced diameter 54, and two slidable caps 55 and 56 are fitted over the area of reduced diameter, holding a coil spring 60 between the respective caps. A fastener 62 is threaded into the end of rod 30 to secure the assembly consisting of caps 55, 56 and coil spring 60 in position on the end of rod 30. Piston 35 is shown near its bottom reciprocation position in FIG. 2. As shown, the undersurface of piston 35 has contacted cap 55 and has caused carriage 26 to become displaced into its lower detent position. When piston 35 reciprocates to its upper reciprocation position cap 56 becomes contacted by surface 58 to reverse the process.

FIG. 3 shows carriage 26 in its upper position, with ball 40 seated in hole 46 and ball 42 seated in hole 50. In this position, collar 24 is slidable into blocking relationship with respect to passage 22, and into opening relationship with respect to passage 33. Passage 33 is in fluid flow coupling with inlet passage 32, and therefore pressurized oil is permitted to flow through inlet 32 into cylinder 45. Outlet passage 34 is blocked from flow relationship with the interior of cylinder 45.

An annular recess 23 is located adjacent neck 20 in porting block 12. Annular recess 23 is sized to accept the upper edge of collar 24. Similarly, an annular recess 25 is located adjacent neck 20 in shoulder 36. Annular recess 25 is sized to accept the lower edge of collar 24. Annular recesses 23 and 25 operate in conjunction with collar 24 to provide a hydraulic cushion or dashpot effect whenever carriage 26 is toggled from one detent position to the other. In operation, the annular recesses always contain some hydraulic oil accumulation, and the fit between collar 24 and each respective recess is sufficiently close so that the trapped hydraulic oil functions to hydraulically cushion collar 24 from sharp mechanical contact at its respective end points.

The operation will be described with reference to the simplified diagrams of FIGS. 4 and 5. FIG. 4 shows a simplified diagram of a conventional spool valve of the type used in the prior art. A spool 60 reciprocates within a valve body under the influence of a trip rod or other similar device attached to the spool, and actuated in a manner generally described herein. Pressurized hydraulic oil enters the valve through inlet 62, and oil is exhausted from the valve to the system through outlet 64. Spool 60 is typically constructed of steel or other solid material, and is stopped at each end of its travel by solid metallic contact with the valve body. In the position shown in FIG. 4 spool 60 is being moved from its leftmost position to its rightmost position by a mechanical force developed along the line indicated by arrow 65, and outlet passage 64 is partially opened. The hydraulic fluid force vectors developed in the annulus surrounding the partially open spool valve are illustrated symbolically in FIG. 4, the net force vector being represented by $F_J$ in the direction of the arrow shown. This force vector acts at an angle 0 which has been theoretically and emperically shown to be about 69°. For a full explanation of this phenomena attention should be directed to the text entitled *Hydraulic Control Systems,* by Herbert E. Merritt, page 101, published by John Wiley & Sons, Inc. A reaction force $F_R$ is formed which is equal and opposite to force $F_J$. Force $F_R$ can be subdivided into its axial component $F_1$ and its radial component $F_2$; since spool valve 60 is circular and the force $F_J$ acts around the entire annulus the force $F_2$ tends to cancel, leaving the axial component $F_1$. Force $F_1$ acts axially leftward, against the mechanical force tending to open the valve. There is therefore an inherent axial force component $F_1$ which opposes the mechanical valve opening force and tends to close the valve, thereby leading to the possibility of instability in operating the conventional spool valve.

Figure 5:
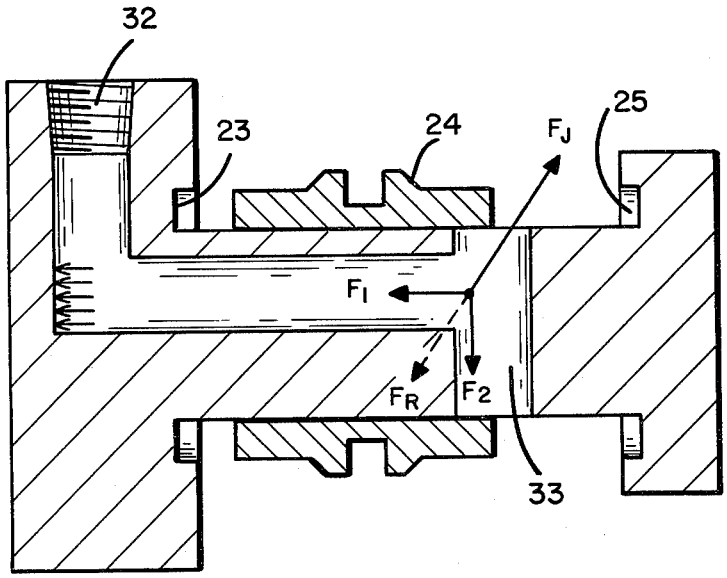
FIG. 5 is a simplified diagram of the invention.

FIG. 5 shows a simplified diagram of the present invention, illustrating the same force components as described above. However, in this case axial force $F_1$ acts against the valve body itself, and does not act against any movable component within the valve. Force $F_1$ therefore has no effect upon the valve slidable collar 24 and therefore the inherent hydraulic forces tending to cause instability are eliminated in the invention. Further, annular recesses 23 and 25 are shown in FIG. 5, and it is apparent that the sliding of collar 24 into either of these recesses will provide a dashpot effect to tend to cushion the impact of collar 24 in its extreme positions against the valve body. This dashpot effect reduces the mechanical shock, and thereby reduces mechanical noise, to contribute to a longer and more effective valve life.

In operation, when carriage 26 is in its upper position as shown in FIG. 3, pressurized oil into inlet 32 is admitted into the upper interior portion of cylinder 45. Pressurized oil is also admitted into inlet 37 which is coupled to cylinder coupling 16 through an external connection (not shown). Since the area of piston 35 exposed to the upper interior portion of cylinder 45 is greater than the area of piston 35 exposed to the lower interior portion of cylinder 45 via inlet 37, there is a net downward pressure force developed across the surface area of piston 35. This net downward force causes piston 35 to move downwardly, which it continues to do until it comes into contact with cap 55. As piston 35 contacts cap 55 it begins to compress spring 60. As further downward movement of piston 35 increases the compression of spring 60, this net downward force on rod 30 soon exceeds the detent force holding carriage 26 in its uppermost position. At the instant this occurs rod 30 and carriage 26 are rapidly toggled downwardly by the force of spring 60, until collar 24 comes into contact with annular recess 25. Oil accumulation in recess 25 will hydraulically cushion the sharp impact of collar 24 against the recess 25, but the detent forces of spring 38, and balls 40 and 42 against the respective holes 46 and 50 in the carriage position the carriage in a stable second position. In this second position, pressurized inlet oil is blocked from entry into the interior of cylinder 45, except via inlet 37 at the bottom of piston 35. At the same time, passage 22 becomes uncovered, thereby permitting oil within the upper portion of cylinder 45 to become exhausted through outlet port 34. The pressure relief provided by passage 22, acting in conjunction with pressurized oil at inlet 37, causes a net upward force against piston 35 and upward movement proceeds until cap 56 becomes contacted by surface 58. The compression forces of spring 60 again come into play and ultimately carriage 26 is toggled into an upward position and balls 40 and 42 are again seated in their second detent position in carriage holes 44 and 48. Annular recess 23 cushions the mechanical shock which would otherwise be suffered when collar 24 contacts porting block 12 during the toggling of carriage 26.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a reciprocable motor of the type having a piston reciprocable within a cylinder under the influence of pressurized fluid selectively valved into the cylinder to reciprocate the piston, the improvement in fluid valving comprising (a) a neck axially projecting into one end of said cylinder (b) a fluid inlet port opening into said cylinder through a first position on said neck, and a fluid outlet port opening into said cylinder through a second position on said neck;

(c) a slidable collar attached about said neck, said collar sized and slidable over said neck to cover either said fluid inlet port or said fluid outlet port; and (d) means for sliding said collar, coupled to said piston, into covering relationship relative to said fluid inlet port and said fluid outlet port.

2. The improvement of claim 1, further comprising detent means for urging said collar into either of two predetermined positions on said neck.

3. The improvement of claim 2, wherein said means for sliding said collar further comprises a rod attached to said piston and connected to said collar.

4. The improvement of claim 3, wherein said means for sliding said collar further comprises a carriage attached to said rod and coupled to said collar.

5. The improvement of claim 4, wherein said carriage further comprises bushing means for concentrically holding said carriage relative to said cylinder.

6. The improvement of claim 5, wherein said collar further comprises a member surrounding said neck.

7. The improvement of claim 6, wherein said collar member further comprises an annular groove for accepting said carriage.

8. The improvement of claim 1, further comprising a shoulder on said neck, said shoulder having a groove sized to partially accept said collar.

9. The improvment of claim 8, further comprising a cap enclosing said cylinder end, said cap having a groove sized to partially accept said collar.

10. The improvement of claim 4, wherein said detent means further comprises a passage through said neck, said passage having therein a pair of balls and a compression spring therebetween, said balls urged against said carriage.

11. The improvement of claim 10, wherein said carriage further comprises four openings sized to partially accept said balls.

12. A reciprocation valve apparatus in a cylinder and operable by a piston axially slidable in said cylinder, comprising:

(a) an inlet passage and an outlet passage into said cylinder, said passages located proximate an end of said cylinder;

(b) a porting block attached to said cylinder and projecting axially into said cylinder, said porting block having a sidewall inside said cylinder and having a first passage in fluid flow communication through said sidewall to said inlet passage, and having a second passage in flow communication through said sidewall to said outlet passage;

(c) a slidable collar surrounding said porting block and slidable into flow blocking relationship over said first and second passages;

(d) a carriage attached to said collar and axially slidable in said cylinder, said carriage having detent means for stopping carriage axial movement in either of two axial positions; and (e) a trip rod attached to said carriage and extending axially toward said piston, and means for actuating said trip rod by said piston at two piston axial positions.

13. The apparatus of claim 12, further comprising support and slide means for axially positioning said carriage in said cylinder.

14. The apparatus of claim 13, wherein said carriage detent means further comprises a compression spring support inside said carriage; a ball at each end of said spring and urged against said carriage by said spring, and a pair of detent seats in said carriage engageable by each of said balls.

15. The apparatus of claim 14, wherein said carriage further comprises a U-clamp engageable against said collar.

16. The apparatus of claim 15, wherein said collar further comprises a peripheral groove against which said U-clamp engages.

17. The apparatus of claim 16, further comprising a first annular recess around said porting block, said first recess sized to partially accept said collar thereinto when said carriage is in one of said two axial positions.

18. The apparatus of claim 17, further comprising a second annular recess around said porting block, said second recess sized to partially accept said collar thereinto when said carriage is in the second of said two axial positions.

* * * * *